US011042113B2

(12) United States Patent
Akamatsu

(10) Patent No.: US 11,042,113 B2
(45) Date of Patent: Jun. 22, 2021

(54) IMAGE FORMING APPARATUS

(71) Applicant: CANON KABUSHIKI KAISHA, Tokyo (JP)

(72) Inventor: Yuki Akamatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/916,627

(22) Filed: Jun. 30, 2020

(65) Prior Publication Data

US 2021/0003958 A1 Jan. 7, 2021

(30) Foreign Application Priority Data

Jul. 1, 2019 (JP) ..... JP2019-123256

(51) Int. Cl.
*G03G 15/20* (2006.01)
*G03G 15/00* (2006.01)

(52) U.S. Cl.
CPC ..... *G03G 15/6573* (2013.01); *G03G 15/2064* (2013.01)

(58) Field of Classification Search
CPC ..... G03G 15/6576; G03G 15/6573; G03G 21/206; G03G 2221/1645
See application file for complete search history.

(56) References Cited

U.S. PATENT DOCUMENTS

2006/0147223 A1* 7/2006 Nishimura ..... G03G 21/206 399/92
2007/0059023 A1* 3/2007 Koshida ..... G03G 15/6573 399/92
2012/0087693 A1* 4/2012 Yamaguchi ..... G03G 21/206 399/92
2012/0087703 A1* 4/2012 Takai ..... G03G 15/6573 399/341
2012/0201564 A1* 8/2012 Masuda ..... G03G 15/2017 399/92
2012/0301174 A1* 11/2012 Masuda ..... G03G 15/6573 399/92
2013/0183059 A1* 7/2013 Yokokawa ..... G03G 15/6576 399/92
2013/0287413 A1* 10/2013 Akamatsu ..... G03G 15/235 399/21
2014/0161481 A1* 6/2014 Udagawa ..... G03G 21/206 399/92
2015/0338796 A1* 11/2015 Koga ..... G03G 15/2025 399/341
2016/0085209 A1* 3/2016 Nakamura ..... B65H 9/00 399/92
2020/0103823 A1* 4/2020 Tanaka ..... G03G 21/206

FOREIGN PATENT DOCUMENTS

JP 2007-86509 A 4/2007
JP 2012-194462 A 10/2012

* cited by examiner

*Primary Examiner* — Sevan A Aydin
(74) *Attorney, Agent, or Firm* — Venable LLP

(57) ABSTRACT

An image forming apparatus includes a fixing portion, a first guiding portion, a second guiding portion, a first rotatable member pair provided between the first and second guiding portions, an air discharging portion for discharging air from a feeding passage of the first guiding portion to an outside of a main assembly of the image forming apparatus, and a second rotatable member pair provided downstream of the second guiding portion.

19 Claims, 3 Drawing Sheets

IMAGE FORMING APPARATUS

FIELD OF THE INVENTION AND RELATED ART

The present invention relates to an image forming apparatus including a fixing means for fixing an image on a sheet by heating the sheet.

In an image forming apparatuses of a laser beam type, such as a printer, a facsimile machine or a multi-function machine, a toner image is transferred onto a sheet and thereafter is heated and pressed by a fixing device, so that the image is fixed on the sheet. From the sheet heated by the fixing device, water vapor generates in some instances, and this water vapor is cooled by a guiding surface forming a feeding passage, so that dew condensation occurs on the guiding surface in some instances. Then, when a water droplet generated by the dew condensation on the guiding surface is deposited on the sheet fed, a feeding resistance increases and causes a sheet (paper) jam, and in the case where double-side printing, improper transfer occurs locally in some instances, and image non-uniformity occurs due to generation of creases of the sheet in some instances.

Therefore, a constitution in which a pair of rollers contacting each other over a full width is provided on a side downstream of the fixing device with respect to a sheet feeding direction and air between the fixing device and the roller pair is discharged and thus dew condensation of water vapor on a guiding plate provided on a side downstream of the roller pair with respect to the sheet feeding direction is intended to be suppressed has been proposed (Japanese Laid-Open Patent Application (JP-A) 2007-86509). Further, a constitution in which a pair of rollers contacting each other over a full width is provided onto a side downstream of the fixing device with respect to the sheet feeding direction similarly as in the above-described constitution and air blowing and air discharging are carried out on a side downstream of the roller pair with respect to the sheet feeding direction and thus the dew condensation on a guiding plate provided on the side downstream of the roller pair with respect to the sheet feeding direction is intended to be suppressed has also been proposed (JP-A 2012-194462).

Incidentally, in recent years, diversification of sheet materials capable of being used in the image forming apparatus has been required. Particularly, when the sheet material with a large basis weight is intended to be used in the image forming apparatus, water content of the sheet material increases, so that water vapor in a large amount is given off of the sheet material heated by the fixing device. For that reason, it has been desired that a degree of the dew condensation on the guiding plate is efficiently reduced.

SUMMARY OF THE INVENTION

A principal object of the present invention is to provide an image forming apparatus capable of efficiently reducing a degree of dew condensation occurring on a side downstream of a fixing means with respect to a sheet feeding direction.

According to an aspect of the present invention, there is provided an image forming apparatus comprising: a fixing portion configured to fix an image on a sheet by heating the sheet; a first guiding portion provided downstream of the fixing portion with respect to a sheet feeding direction and configured to form a first feeding passage along which the sheet is fed; a second guiding portion provided downstream of the first feeding passage with respect to the sheet feeding direction and configured to form a second feeding passage along which the sheet is fed; a first rotatable member pair provided between the first guiding portion and the second guiding portion with respect to the sheet feeding direction and configured to feed the sheet, wherein the first rotatable member pair includes one rotatable member and the other rotatable member which are in contact with each other over a full width of the first feeding passage with respect to a widthwise direction perpendicular to the sheet feeding direction in a state in which the first rotatable member pair does not feed the sheet; an air discharging portion configured to discharge air from the first feeding passage to an outside of a main assembly of the image forming apparatus; and a second rotatable member pair provided downstream of the second guiding portion with respect to the sheet feeding direction, wherein the second rotatable member pair includes one rotatable member and the other rotatable member which are in contact with each other over a full width of the second feeding passage with respect to the widthwise direction in a state in which the second rotatable member pair does not feed the sheet.

Further features of the present invention will become apparent from the following description of exemplary embodiments with reference to the attached drawings.

DESCRIPTION OF EMBODIMENTS

First Embodiment

In the following, an image forming apparatus according to a first embodiment of the present invention will be described with reference to the drawings. The image forming apparatus includes a printer, a copying machine, a facsimile machine and a multi-function machine and forms an image on a sheet used as a recording medium on the basis of image information inputted from an external PC (personal computer) or image information read from an original. The sheet used as the recording medium includes papers such as plain paper and thick paper, plastic films such as a sheet for an overhead projector, sheets having particular shapes, such as an envelope and index paper, and a cloth.

Figure 1:
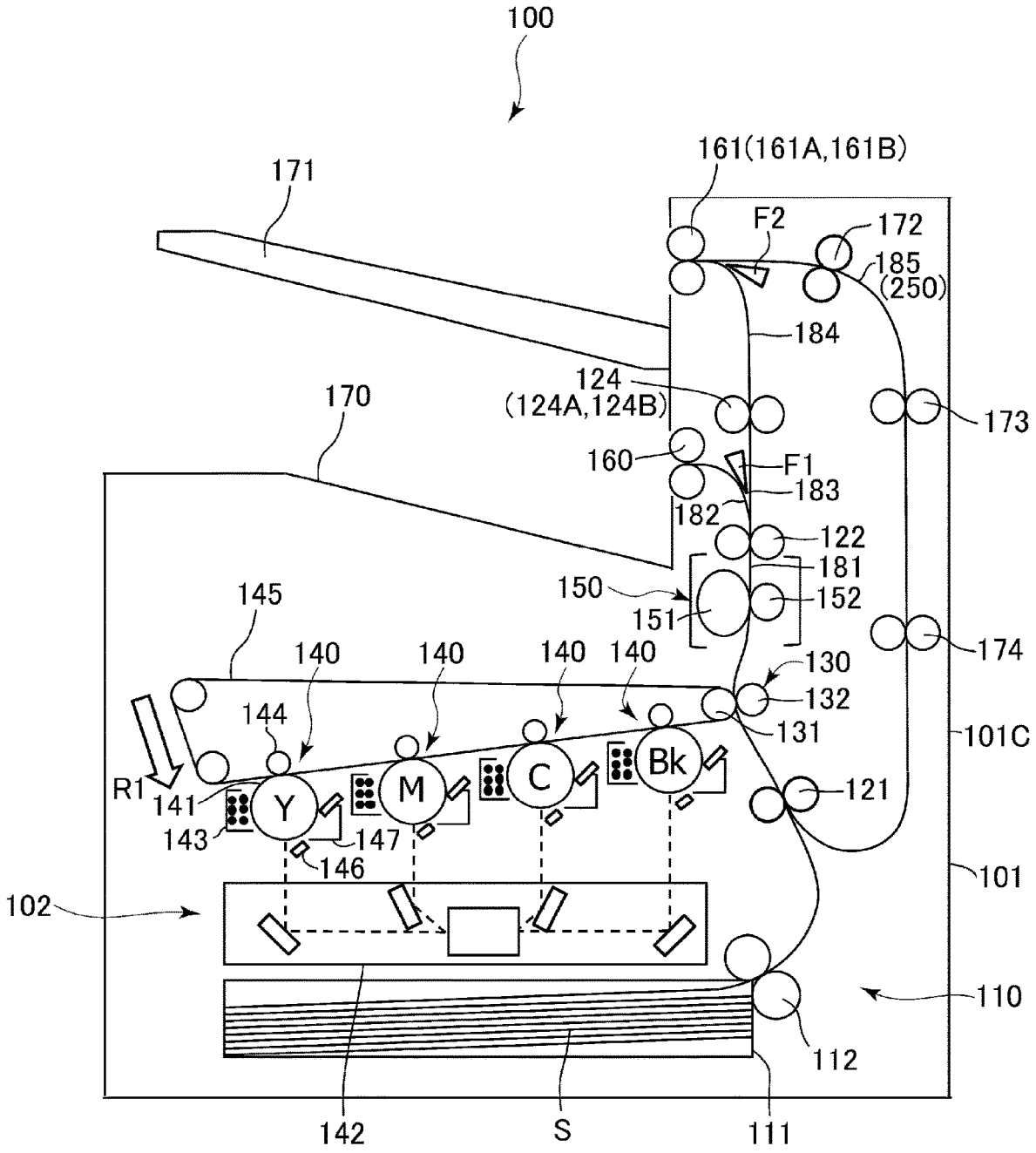
FIG. 1 is a schematic sectional view showing entirety of an image forming apparatus according to a first embodiment.

FIG. 1 is a schematic sectional view showing entirety of an image forming apparatus 100 according to the first embodiment. In an apparatus main assembly 101 of the image forming apparatus 100, as an example of an image forming means, an image forming portion 102 of an electrophotographic type is mounted. The image forming portion 102 is an electrophotographic unit of a so-called intermediary transfer tandem type in which four image forming units 140 for forming toner images of four colors of yellow (Y), magenta (M), cyan (C) and black (Bk) are provided along an intermediary transfer belt 145.

The image forming portion 102 includes the image forming units 140, the intermediary transfer belt 145, an inner secondary transfer roller 131 and an outer secondary transfer roller 132. Each of the image forming units 140 includes a photosensitive drum 141 as a photosensitive member, a developing device 143, a primary transfer device 144, a charging device 146, and a cleaning device 147. The photosensitive drum 141 of each of the image forming units 140 is constituted so as to be irradiated with laser light emitted from an exposure device 142 provided at a lower portion of the apparatus main assembly 101. When the image forming process is started, the photosensitive drum 141 electrically charged uniformly in advance by the charging device 146 is irradiated with the laser light emitted from the exposure device 142, so that the photosensitive drum 141 is exposed to the laser light. At this time, the exposure device 142 has already received a signal (video signal) corresponding to data of an image to be printed and emits laser light modulated depending on the video signal, and the photosensitive drum 141 is irradiated with the laser light through an optical system including a polygon mirror. As a result, an electrostatic latent image corresponding to the image data is formed on a surface of the photosensitive drum 141.

The developing device 143 supplies toner to the electrostatic latent image formed on the photosensitive drum 141, so that the latent image is visualized (developed) into a toner image. Thereafter, a predetermined pressing force and a predetermined electrostatic load bias are applied by the primary transfer device 144, so that the toner image is primary-transferred from the photosensitive drum 141 onto the intermediary transfer belt 145. Incidentally, residual toner remaining on the photosensitive drum 141 after primary transfer is collected by the cleaning device 147, so that a drum surface of the photosensitive drum 141 is cleaned.

The intermediary transfer belt 145 is rotationally driven in an arrow R1 direction of FIG. 1. A toner image forming operation described above is performed in parallel in the respective image forming units 140. Further, primary transfer of the toner images onto the intermediary transfer belt 145 is carried out so that the toner image formed by the image forming unit 140 on a downstream side is superposed on the toner image formed by the image forming unit 140 on an upstream side. As a result, consequently, a full-color toner image is formed on the intermediary transfer belt 145 and is carried by the intermediary transfer belt 145, and thus is fed toward a secondary transfer portion 130 as a transfer portion.

The secondary transfer portion 130 is a nip formed by the inner secondary transfer roller 131 and the outer secondary transfer roller 132 which oppose each other, and the toner image is transferred from the intermediary transfer belt 145 onto a sheet S while the sheet S is nipped and fed. That is, a predetermined pressing force and an electrostatic load bias are applied by the outer secondary transfer roller 132, so that the toner images are transferred from the intermediary transfer belt 145 onto the sheet S.

Thereafter, the sheet S is fed toward a fixing device 150 as a fixing means for heating the toner image under application of heat and pressure. The fixing device 150 includes a heating belt 151 as a rotatable heating member in which an unshown heater is incorporated and a pressing roller 152 as a rotatable pressing member pressed against the heating belt 151. The fixing device 150 applies heat and pressure to the toner images while nipping and feeding the sheet S by these heating belt 151 and pressing roller 152. As a result, the toner is melted and thereafter is solidified, so that the toner is fixed on the sheet S and thus the image is fixed on the sheet S.

On the other hand, the sheet used as the recording medium is supplied to the image forming portion 102 by a sheet feeding device 110. The sheet feeding device 110 includes a cassette 111 including a lift-up device moving upward and downward in a state in which the sheets S are stacked and includes a feeding roller pair 112 for feeding the sheets S one by one from the cassette 111. The sheet S fed by the feeding roller pair 112 is fed toward a registration roller pair 121 through a feeding passage. The registration roller pair 121 corrects oblique movement of the sheet S and then feeds the sheet S toward the secondary transfer portion 130 at timing determined in synchronism with the toner image forming operation by the image forming portion 102.

The sheet S on which the toner image is transferred at the secondary transfer portion 130 and then is fixed as a fixed image by the fixing device 150 passes through a feeding passage 181 and is fed by a fixing discharging roller pair 122, and then reaches a branch portion where a first switching flap F1 is provided. The first switching flap F1 guides the sheet S to either one of a feeding passage 182 toward a first discharging roller pair 160 which is a first rotatable discharging member pair and a feeding passage 183 toward a second discharging roller pair 161 which is a second rotatable discharging member pair (another rotatable discharging member pair). The sheet S fed toward the feeding passage 182 is fed to the first discharging roller pair 160 by the fixing discharging roller pair 122. The sheet S reached the first discharging roller pair 160 is discharged by the first discharging roller pair 160 onto a first discharge tray 170 provided at an upper portion of the apparatus main assembly 101.

On the other hand, the sheet S fed toward the feeding passage 183 is fed along the feeding passage 184 by a branch feeding roller pair 124 as a branch rotatable member pair and is fed to the second discharging roller pair 161 disposed at a position above (different from) a position of the first discharging roller pair 160.

The sheet S reached the second discharging roller pair 161 is discharged as it is by the second discharging roller pair 161 onto a second discharge tray 171 provided over the first discharge tray 170 or is reversed and fed by a reversing operation of the second discharging roller pair 161 in the case where double-side printing is carried out. In the case where the double-side printing is carried out, the reversed sheet S is guided by a second switching flap F2 to a double-side (printing) feeding passage 185 as a re-feeding passage formed by a re-feeding guiding means 250. The sheet S guided to the double-side feeding passage 185 is turned upside down and is fed again to the registration roller pair 121 by double-side (printing) feeding roller pairs 172, 173 and 174. The sheet S reached the registration roller pair 121 is discharged onto either one of the discharge trays 170 and 171 after an image is formed on a second surface in a step similar to the step for a first surface on which the image has already been formed.

[Feeding Path from Fixing Device to a First Discharging Roller Pair and Structure of Air Discharging Device]

Figure 2:
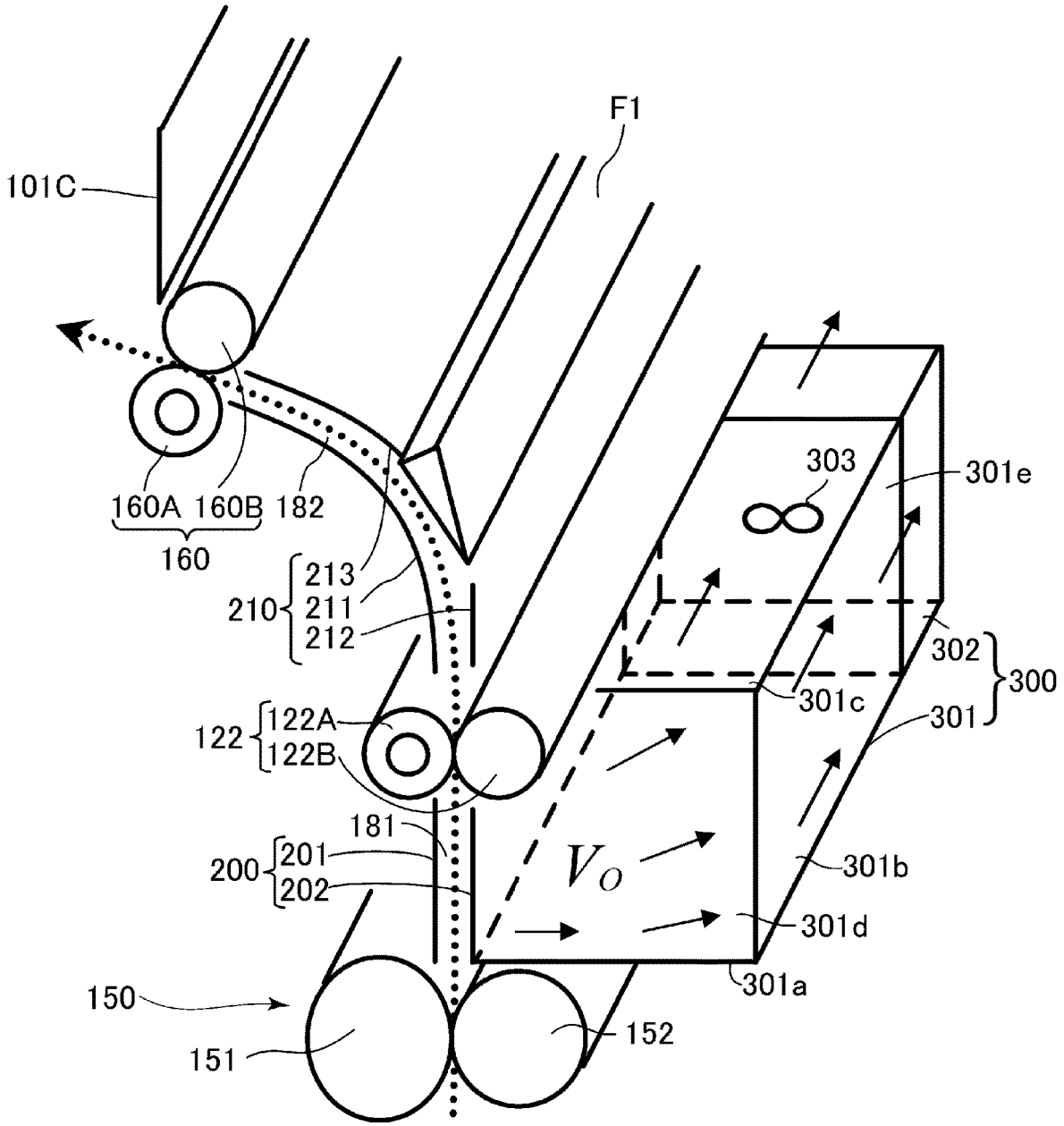
FIG. 2 is a schematic perspective view showing from a fixing device to a discharging roller pair in the first embodiment.

Then, a feeding path from the fixing device 150 to the first discharging roller pair 160 and a structure of an air discharging device 300 will be described with reference to FIG. 2. As shown in FIG. 2, from the fixing device 150 toward a downstream side with respect to the sheet feeding direction, the feeding passage 181 as a first feeding passage, the fixing discharging roller pair 122 as a first rotatable member pair, the feeding passage 182 as a second feeding passage, and the first discharging roller pair 160 as a second rotatable member pair are disposed.

The feeding passage 181 is formed as a feeding passage along which the sheet is fed by a first guiding means 200 including a pair of guiding members 201 and 202 which oppose each other and which are formed in a plate-like shape. The guiding member 201 is disposed on a side where the heating belt 151 of the fixing device 150 is disposed relative to the feeding passage 181. Further, the guiding member 201 is disposed so that an upstream end portion thereof with respect to the sheet feeding direction extends to the neighborhood of the heating belt 151 with a gap (for example, about 1 mm) formed in consideration of a component tolerance or the like. Further, the guiding member 201 is disposed so that a downstream end portion thereof with respect to the sheet feeding direction extends to the neighborhood of a driving roller 122A of the image form discharging roller pair 122 with a gap (for example, about 1 mm) formed in consideration of the component tolerance or the like.

On the other hand, the guiding member 202 is disposed on a side where the pressing roller 152 of the fixing device 150 is disposed relative to the feeding passage 181. Further, the guiding member 202 is disposed so that an upstream end portion thereof with respect to the sheet feeding direction extends to the neighborhood of the pressing roller 152 with a gap (for example, about 1 mm) formed in consideration of a component tolerance or the like. Further, the guiding member 202 is disposed so that a downstream end portion thereof with respect to the sheet feeding direction extends to the neighborhood of a follower roller 122B of the image form discharging roller pair 122 with a gap (for example, about 1 mm) formed in consideration of the component tolerance or the like. Further, on a side opposite from the feeding passage 181 of the guiding member 202, not only an air discharging duct 301 of the air discharging device 300 as an air discharging means described later is provided, but also the guiding member 202 is provided with a plurality of through holes, so that an inside of the feeding passage 181 and an inside of the air discharging duct 301 communicate with each other.

The above-described fixing discharging roller pair 122 includes the driving roller 122A and the follower roller 122B as a pair of rotatable members. Each of these driving roller 122A and follower roller 122B is formed with, for example, a single cylindrical-shaped member made of a rubber, and those rollers are disposed so that opposite ends thereof are positioned outside opposite ends of the feeding passage 181 with respect to a widthwise direction perpendicular to the sheet feeding direction. That is, the driving roller 122A and the follower roller 122B form a nip in which entire portions (full widths) thereof with respect to the widthwise direction are in a contact state in a state in which the sheet is not fed through the nip and are disposed over a full width of the feeding passage 181 ranging between the opposite ends of the feeding passage 181. By this, the feeding passage 181 and the feeding passage 182 are blocked by the fixing discharging roller pair 122 and are constituted so as to be in a blocked state in which the air does not directly flow through the nip therebetween although the air leaks through a gap formed due to a component tolerance or the like.

The feeding passage 182 is formed as a feeding passage along which the sheet is fed by a second guiding means 210 including a pair of guiding members 211 and 212 and a pair of guiding members 211 and 213 which oppose each other and which are formed in a plate-like shape. The guiding member 211 is disposed on a side where the heating belt 151 of the fixing device 150, the guiding member 201 and the driving roller 122A of the fixing discharging roller pair 122 are disposed relative to the feeding passage 182. Further, the guiding member 211 is disposed so that an upstream end portion thereof with respect to the sheet feeding direction extends to the neighborhood of the driving roller 122A with a gap (for example, about 1 mm) formed in consideration of a component tolerance or the like. Further, the guiding member 211 is disposed so that a downstream end portion thereof with respect to the sheet feeding direction extends to the neighborhood of a driving roller 160A of the first discharging roller pair 160 with a gap (for example, about 1 mm) formed in consideration of the component tolerance or the like.

On the other hand, the guiding member 212 is disposed on a side where the pressing roller 152 of the fixing device 150, the guiding member 202 and the follower roller 122B of the fixing discharging roller pair 122 are disposed relative to the feeding passage 182. Further, the guiding member 212 is disposed so that an upstream end portion thereof with respect to the sheet feeding direction extends to the neighborhood of the follower roller 122B with a gap (for example, about 1 mm) formed in consideration of a component tolerance or the like. Further, the guiding member 212 is continuously connected to a guiding member forming the feeding passage 183 (FIG. 1) as the branch feeding passage at an end portion thereof positioned on a downstream side with respect to the sheet feeding direction.

Further, the guiding member 213 is disposed on a side where the pressing roller 152 of the fixing device 150, the guiding member 202, the follower roller 122B of the fixing discharging roller pair 122, the guiding member 212 and the first switching flap F1 are disposed relative to the feeding passage 182. Further, the guiding member 213 is disposed so that an upstream end portion thereof with respect to the sheet feeding direction extends to the neighborhood of the first switching flap F1 with a gap (for example, about 1 mm) formed in consideration of the component tolerance or the like. Further, the guiding member 213 is disposed so that a downstream end portion thereof with respect to the sheet feeding direction extends to the neighborhood of a follower roller 160B of the first discharging roller pair 160 with a gap (for example, about 1 mm) formed in consideration of the component tolerance or the like.

The above-described first discharging roller pair 160 includes the driving roller 122A and the follower roller 160B as a pair of rotatable members. Each of these driving roller 160A and follower roller 160B is formed with, for example, a single cylindrical-shaped member made of a rubber, and those rollers are disposed so that opposite ends thereof are positioned outside opposite ends of the feeding passage 182 with respect to the widthwise direction. That is, the driving roller 160A and the follower roller 160B form a nip in which entire portions (full widths) thereof with respect to the widthwise direction are in a contact state in a state in which the sheet is not fed through the nip and are disposed over a full width of the feeding passage 182 ranging between the opposite ends of the feeding passage 181. By this, the feeding passage 182 and the outside of the apparatus main assembly 101 are blocked by the first discharging roller pair 160 and are constituted so as to be in a blocked state in which the air does not directly flow through the nip therebetween although the air leaks through a gap formed due to a component tolerance or the like. Incidentally, the driving roller 160A and the follower roller 160B are disposed in the neighborhood of a main assembly cover 101C constituting an outer casing of the apparatus main assembly 101 with a gap (for example, about 1 mm) formed in consideration of a component tolerance or the like. By this, the blocked state between the feeding passage 182 and the outside of the apparatus main assembly 101 is enhanced.

Incidentally, as shown in FIG. 1, the branch feeding roller pair 124 is disposed on a side downstream of the feeding passage 183 with respect to the sheet feeding direction and on a side upstream of the feeding passage 184 with respect to the sheet feeding direction. Also as regards this branch feeding roller pair 124. Each of these driving roller 124A and follower roller 124B as a pair of rotatable members is formed with, for example, a single cylindrical-shaped member made of a rubber, and those rollers are disposed so that opposite ends thereof are positioned outside opposite ends of the feeding passage 182 with respect to the widthwise direction. That is, the branch feeding roller pair 124 forms a nip in which entire portions (full widths) thereof with respect to the widthwise direction are in a contact state in a state in which the sheet is not fed through the nip and are disposed over full widths ranging between the opposite ends of the feeding passages 183 and 184. By this, the feeding passage 183 and the feeding passage 184 are blocked by the branch feeding roller pair 124 and are constituted so as to be in a blocked state in which the air does not directly flow through the nip therebetween although the air leaks through a gap formed due to a component tolerance or the like.

In summary, the feeding passage 182 and the feeding passage 183 are put in the blocked state by the fixing discharging roller pair 122, the first discharging roller pair 160 and the branch feeding roller pair 124, and are particularly constituted so that the air does not readily flow (more) to the feeding passage 181 and the outside of the apparatus main assembly 101.

Incidentally, in this embodiment, the air is blocked by the branch feeding roller pair 124, but the branch feeding roller pair 124 may also be constituted by a plurality of comb-(teeth) shaped rollers provided at a plurality of positions with respect to an axial direction. In this case, irrespective of the branch feeding roller pair 124, the feeding passage 183 and the feeding passage 184 are in a communication state with each other in terms of a flow of the air. However, the second discharging roller pair 161 can be constituted by the driving roller 161A and the follower roller 161B which are a pair of rotatable members forming a nip in which these rollers are in a contact state over full widths thereof in a state in which the sheet is not fed through the nip. By this, the feeding passages 182, 183 and 184 are put in the blocked state by the fixing discharging roller pair 122, the first discharging roller pair 160 and the second discharging roller pair 161 and are particularly constituted so that the air does not readily flow to the feeding passage 181 and the outside of the apparatus main assembly 101.

Then, the structure of the air discharging device 300 will be described. As shown in FIG. 2, the air discharging device 300 discharging the air of the feeding passage 181 to the outside includes the air discharging duct 301 and an air discharging fan device 302 connected to an opening 301*e* of the air discharging duct 301. The air discharging duct 301 includes a lower wall 301*a*, a side wall 301*b*, an upper wall 301*c* and a side end wall 301*d*. The air discharging duct 301 is formed in a cylindrical shape with respect to the widthwise direction by the guiding member 202, the lower wall 301*a*, the side wall 301*b* and the upper wall 301*c*, and a font-side end which is one of opposite ends of the air discharging duct 301 with respect to the widthwise direction is closed by the side end wall 301*d*. For this reason, a rear-side end which is the other one of the opposite ends with respect to the widthwise direction constitutes an opening 301*e* through which the air discharging fan device 302 is connected to the air discharging duct 301. The air discharging fan device 302 includes a fan 303, and the fan 303 discharges the air of the feeding passage 181 to the outside of the apparatus main assembly 101, i.e., toward the rear surface side of the apparatus main assembly 101 at an air velocity Vo through the inside of the air discharging duct 301.

[Flow of Water Vapor and Reduction of Dew Condensation]

Then, in the image forming apparatus 100 according to the first embodiment, a flow of water vapor generating from the sheet S heated by the fixing device 150 and reduction in degree of dew condensation in a second guiding means 210 will be described. It has been known that from the sheet S heated and pressed by the heating belt 151 and the pressing roller 152 of the fixing device 150, the water vapor is liable to generate from a surface opposite from a surface on a side where the sheet S is pressed by the heating belt 151, i.e., from a side where the pressing roller 152 is disposed.

As shown in FIG. 2, when the sheet S heated by the fixing device 150, the water vapor generates (is emitted) from the side where the pressing roller 152 in the feeding passage 181 is disposed, but the water vapor is sucked by the air discharging device 300 and is discharged to the outside of the pressing roller 152. That is, the water vapor in the feeding passage 181 is discharged, whereby the water vapor does not readily diffuse into the feeding passage 182. Incidentally, when the air is discharged by the air discharging device 300, a constitution in which the air is easily sucked from a side upstream of the feeding passage 181 with respect to the sheet feeding direction, i.e., from the fixing device 150 side is employed, and thus a constitution in which a flow of the air in the feeding passage 182 does not readily generate is employed.

Thereafter, the heated sheet S is fed to the feeding passage 182 by the fixing discharging roller pair 122 or is fed from the feeding passage 182 to the feeding passage 183 by switching of the first switching flap F1. These feeding passages 182 and 183 are constituted so as not to readily cause the flow of the air by the fixing discharging roller pair 122, the first discharging roller pair 160 and the branch feeding roller pair 124 as described above. For that reason, these feeding passages 182 and 183 are increased in temperature by the heated sheet S, but the feeding passages are in the blocked state and a lowering in temperature due to cooling by the air from the outside of the apparatus main assembly 101 or from another portion of the inside of the apparatus main assembly 101 is intended to be prevented. Accordingly, even when the water vapor is continuously emitted from the sheet S, prevention of cooling of the water vapor in the feeding passage 182 or in the feeding passage 183 is realized, so that a degree of occurrence of the dew condensation on the guiding members 211, 212 and 213 is reduced.

Incidentally, although the feeding passages 182 and 183 are in the blocked state, as described above, there are slight gaps between the guiding members 211, 212 and 213 and the associated roller pair consisting of the fixing discharging roller pair 122, the first discharging roller pair 160 and the branch feeding roller pair 124. For that reason, the water vapor emitted to the feeding passage 182 and the feeding passage 183 does not cause dew condensation but is gradually discharged to the outside of these feeding passages 182 and 183.

As described above, according to the image forming apparatus 100 of the first embodiment, the lowering in temperature of the feeding passage 182 is suppressed, and in combination with the discharge of the water vapor in the feeding passage 181 by the air discharging device 300, it is possible to reduce the degree of the occurrence of the dew condensation particularly in the feeding passage 182.

Second Embodiment

Then, a second embodiment in which the above-described first embodiment is partly changed will be described. Incidentally, in description of the second embodiment, portions similar to those in the above-described first embodiment are represented by the same reference numerals or symbols and will be omitted from description.

Compared with the first embodiment, an image forming apparatus 100 according to the second embodiment roughly further includes a pre-discharging roller pair 123 which is a rotatable feeding roller pair and an air blowing device 400. Further, between the air discharging device 300 and the air blowing device 400, a blocking portion 500 is provided. By this, with respect to the sheet feeding direction, the feeding passage 181 as the first feeding passage is provided on a side downstream of the fixing device 150 and upstream of the fixing discharging roller pair 122. Further, with respect to the sheet feeding direction, a feeding passage 186 as a second feeding passage is provided on a side downstream of the fixing discharging roller pair 122 and upstream of the pre-discharging roller pair 123, and a feeding passage 187 as a third feeding passage is provided on a side downstream of the pre-discharging roller pair 123 and upstream of the first discharging roller pair 160.

As described above, the feeding passage 181 is formed by a pair of guiding members 201 and 202, of a first guiding means 200, opposed to each other and formed in a plate-like shape. Further, the feeding passage 186 is formed by a pair of guiding members 221 and 222, of a second guiding means 220, opposed to each other and formed in a plate-like shape. Further, the feeding passage 187 is formed by a pair of guiding members 231 and 233 and a pair of guiding members 231 and 232, of a third guiding means 230, opposed to each other and formed in a plate-like shape. Incidentally, similarly as in the first embodiment, the feeding passage 187 is connected to the feeding passage 183 (FIG. 1) which is the branch feeding passage, and a part of the guiding member 233 opposes the guiding member 231 and a remaining part of the guiding member 233 forms the feeding passage 183.

Specifically, the guiding member 221 is disposed on a side where the heating belt 151 of the fixing device 150, the guiding member 201 and the driving roller 122A of the fixing discharging roller pair 122 are disposed relative to the feeding passage 186. Further, the guiding member 221 is disposed so that an upstream end portion thereof with respect to the sheet feeding direction extends to the neighborhood of the driving roller 122A with a gap (for example, about 1 mm) formed in consideration of a component tolerance or the like. Further, the guiding member 221 is disposed so that a downstream end portion thereof with respect to the sheet feeding direction extends to the neighborhood of a driving roller 123A of the pre-discharging roller pair 123 with a gap (for example, about 1 mm) formed in consideration of the component tolerance or the like.

On the other hand, the guiding member 222 is disposed on a side where the pressing roller 152 of the fixing device 150, the guiding member 202 and the follower roller 122B of the fixing discharging roller pair 122 are disposed relative to the feeding passage 186. Further, the guiding member 222 is disposed so that an upstream end portion thereof with respect to the sheet feeding direction extends to the neighborhood of the follower roller 123B with a gap (for example, about 1 mm) formed in consideration of a component tolerance or the like. Further, on a side opposite from the feeding passage 186 of the guiding member 222, the blocking portion 500 described later is disposed.

The pre-discharging roller pair 123 includes the driving roller 123A and a follower roller 123B as a pair of rotatable members. Each of the driving roller 123A and the follower roller 123B is formed with, for example, a single cylindrical-shaped member made of a rubber, and these rollers are disposed so that opposite ends thereof are positioned outside opposite ends of the feeding passages 186 and 187 with respect to the widthwise direction. That is, the driving roller 125A and the follower roller 123B from a nip in which entire portions (full widths) thereof with respect to the widthwise direction are in a contact state in a state in which the sheet S is not fed through the nip and are disposed over full widths ranging between the opposite ends of the feeding passage 186 and 187. By this, the feeding passages 186 and 181 are blocked by the fixing discharging roller pair 122, and the feeding passages 186 and 187 are blocked by the pre-discharging roller pair 123. Accordingly, the feeding passage 186 is constituted so as to be in a blocked state in which the air does not directly flow through the nip although the air leaks through a gap formed due to a component tolerance or the like.

The above-described guiding member 231 is disposed on a side where the heating belt 151 of the fixing device 150, the guiding member 201, the driving roller 122A of the fixing discharging roller pair 122, the guiding member 221 and the driving roller 123A of the pre-discharging roller pair 123 are disposed relative to the feeding passage 187. Further, the guiding member 231 is disposed so that an upstream end portion thereof with respect to the sheet feeding direction extends to the neighborhood of the driving roller 123A with a gap (for example, about 1 mm) formed in consideration of the component tolerance or the like. Further, the guiding member 231 is disposed so that a downstream end portion thereof with respect to the sheet feeding direction extends to the neighborhood of the driving roller 160A of the first discharging roller pair 160 with a gap (for example, about 1 mm) formed in consideration of the component tolerance or the like.

Further, the guiding member 233 is disposed on a side where the pressing roller 152, the guiding member 202, the follower roller 122B of the fixing discharging roller pair 122, the guiding member 222, the follower roller 123B of the pre-discharging roller pair 123 and the first switching flap F1 are disposed relative to the feeding passage 187. Further, the guiding member 233 is disposed so that an upstream end portion thereof with respect to the sheet feeding direction extends to the neighborhood of the follower roller 123B of the pre-discharging roller pair 123 with a gap (for example, about 1 mm) formed in consideration of the component tolerance or the like. Further, on a side opposite from the feeding passage 187 of the guiding member 233, not only an air blowing duct 401 of the air blowing device 400 as an air blowing means described later is provided, but also the guiding member 233 is provided with a plurality of through holes, so that the feeding passage 187 and the inside of the air blowing duct 401 communicate with each other through the through holes.

On the other hand, the guiding member 232 is disposed on a side where the pressing roller 152 of the fixing device 150, the guiding member 202, the follower roller 122B of the fixing discharging roller pair 122, the guiding member 222 and the follower roller 123B of the pre-discharging roller pair 123 are disposed relative to the feeding passage 187. Further, the guiding member 232 is disposed so that an upstream end portion thereof with respect to the sheet feeding direction extends to the neighborhood of the first switching flap F1 with a gap (for example, about 1 mm) formed in consideration of the component tolerance or the like.

Each of the driving roller 160A and the follower roller 160B of the first discharging roller pair 160 in the second embodiment is constituted by juxtaposing a plurality of rollers along an axial direction. For example, the follower roller 160B is constituted in the form such that a plurality of rollers 160Ba are supported on a shaft 160Bb. Incidentally, although illustration is omitted, the plurality of rollers of the driving roller 160A are provided at the same positions as the positions of the plurality of rollers 160Ba of the follower roller 160B and are in contact with the rollers 160Ba of the follower roller 160B, respectively, so that a plurality of nips are formed. That is, the driving roller 160A and the follower roller 160B form a plurality of gaps between the associated opposing rollers thereof, so that a structure such that the air flows through the gaps is formed. That is, the feeding passage 187 communicates with the outside of the apparatus main assembly 101 through the opening of the main assembly cover 101C of the apparatus main assembly 101.

In the second embodiment, the branch feeding roller pair 124 and the second discharging roller pair 161 (FIG. 1) are also constituted so as to include a plurality of rollers similarly as in the case of the first discharging roller pair 160. Accordingly, the feeding passage 183 and the feeding passage 184 also communicate with each other through the opening of the main assembly cover 101C of the apparatus main assembly 101.

The air discharging device 300 in the second embodiment is formed in an L-shape as seen in the widthwise direction. That is, the air discharging device 300 includes an upper wall 301*g* on a side upstream of the follower roller 122B of the fixing discharging roller pair 122 with respect to the sheet feeding direction, and a side wall 301*f* connecting the upper wall 301*g* and an upper wall 301*c* and opposing the blocking portion 500 described later. The upper wall 301*c* is bonded to a lower wall 401*a* of the air blowing device 400 described later. Accordingly, the air discharging device 300 not only covers the blocking portion 500 described later from two directions but also is connected to the bottom of the air blowing device 400 described later. Incidentally, the upper wall 301*c* may also be omitted, so that the air discharging duct 301 may also be constituted by using the lower wall 401*a* of the air blowing device 400 described later.

The blocking portion 500 includes a lower wall 501*a*, a side wall 501*b* and a side end wall 501*d* each formed in a wall shape. Incidentally, the blocking portion 500 also includes a side end wall (not shown) on a side opposite from the side end wall 501*d* with respect to the widthwise direction. The lower wall 501*a* of the blocking portion 500 is disposed on a side downstream of the follower roller 122B of the fixing discharging roller pair 122 with respect to the sheet feeding direction and is connected to the guiding member 222. Further, the side wall 501*b* is caused to stand so as to opposite the side wall 301*f* of the discharging device 300, so that an upper end thereof extends to the neighborhood of the lower wall 401*a* of the air blowing device 400 described later. Accordingly, the blocking portion 500 blocks an inside space by a double structure in a region defined by the air discharging duct 301 of the air discharging device 300 and the air blowing duct 401 of the air blowing device 400.

The air blowing device 400 blowing the air to the feeding passage 187 includes the air blowing duct 401 and an air blowing fan device 402 connected to an opening 401*e* of the air blowing duct 401. The air blowing duct 401 includes a lower wall 401*a*, a side wall 401*b*, an upper wall 401*c* and a side end wall 401*d*. The air blowing duct 401 is formed in a cylindrical shape with respect to the widthwise direction by the lower wall 401*a*, the side wall 401*b*, the upper wall 401*c* and the guiding member 233, and a font-side end which is one of opposite ends of the air blowing duct 401 with respect to the widthwise direction is closed by the side end wall 401*d*. For this reason, a rear-side end which is the other one of the opposite ends with respect to the widthwise direction constitutes an opening 401*e* through which the air blowing fan device 402 is connected to the air discharging duct 301. The air blowing fan device 402 includes a fan 403, and the fan 403 blows the air to the feeding passage 187 and then to the outside of the apparatus main assembly 101 at an air velocity $V_I$ through the inside of the air blowing duct 401 and the plurality of through holes of the guiding member 233, i.e., from the rear surface side of the apparatus main assembly 101. [Flow of water vapor and reduction of dew condensation]

Then, in the image forming apparatus 100 according to the second embodiment, a flow of water vapor generating from the sheet S heated by the fixing device 150 and reduction in degree of dew condensation in the second guiding means 220 and a third guiding means 230 will be described. Similarly as in the first embodiment from the sheet S heated and pressed by the fixing device 150, the water vapor is liable to generate from a side where the pressing roller 152 is disposed.

Figure 3:
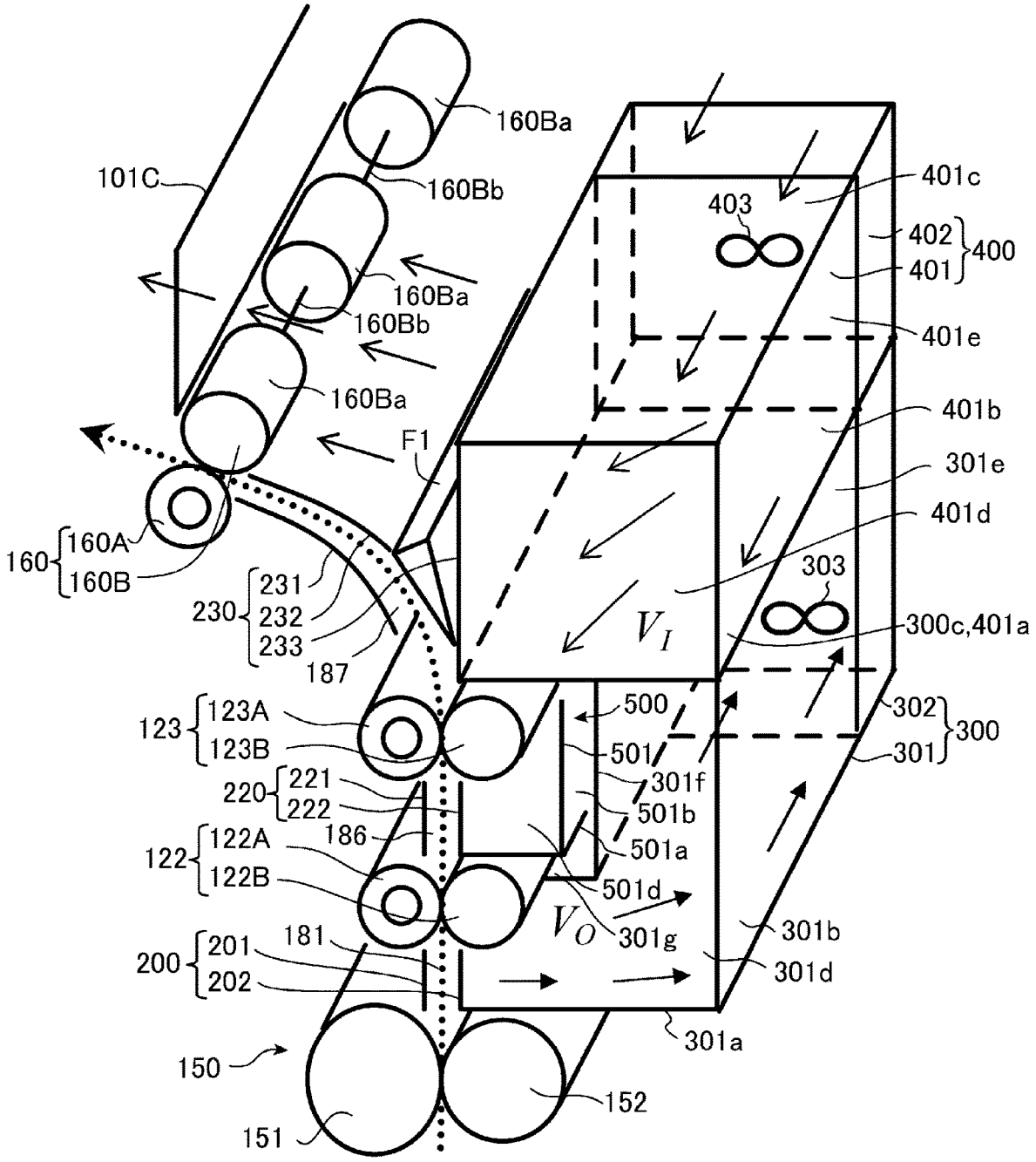
FIG. 3 is a schematic perspective view showing from a fixing device to a discharging roller pair in a second embodiment.

As shown in FIG. 3, when the sheet S heated by the fixing device 150 the water vapor generates (is emitted) from the side where the pressing roller 152 in the feeding passage 181 is disposed, but the water vapor is sucked by the air discharging device 300 and is discharged to the outside of the pressing roller 152. That is, the water vapor in the feeding passage 181 is discharged, whereby the water vapor does not readily diffuse into the feeding passage 186. Incidentally, when the air is discharged by the air discharging device 300, a constitution in which the air is easily sucked from a side upstream of the feeding passage 181 with respect to the sheet feeding direction, i.e., from the fixing device 150 side is employed, and thus a constitution in which a flow of the air in the feeding passage 186 does not readily generate is employed.

Thereafter, the heated sheet S is fed to the feeding passage 186 by the fixing discharging roller pair 122. The feeding passage 186 is are constituted so as not to readily cause the flow of the air by the fixing discharging roller pair 122 and the pre-discharging roller pair 123 as described above. Further, the blocking portion 500 is disposed outside the guiding member 222 relative to the feeding passage 186, and in combination with the double structure thereof with the air discharging duct 301 and the air blowing duct 401, heat transfer does not readily occur. Further, the blocking portion 500 blocks the flow of the air between the discharging roller pair 122 and the pre-discharging roller pair 123, particularly between the guiding member 202 which is an air inlet portion of the air discharging device 300 and the guiding member 233 which is an air outlet portion of the air blowing device 400. For that reason, the feeding passage 186 is increased in temperature by the heated sheet S, but the feeding passages are in the blocked state and a lowering in temperature due to cooling by the air from the outside of the apparatus main assembly 101 or from another portion of the inside of the apparatus main assembly 101 is intended to be prevented. Accordingly, even when the water vapor is continuously emitted from the sheet S, prevention of cooling of the water vapor in the feeding passage 186 is realized, so that a degree of occurrence of the dew condensation on the guiding members 221 and 222 is reduced.

Further, the sheet S is fed to the feeding passage 187 by the pre-discharging roller pair 123 or is fed from the feeding passage 187 to the feeding passage 183 by switching of the first switching flap F1. To the feeding passage 187, as described above, the air is blown from the air blowing device 400 and passes through the first discharging roller pair 160 and through the branch feeding roller pair 124 and the second discharging roller pair 161, so that the air in the feeding passages 187, 183 and 184 is discharged to the outside of the apparatus main assembly 101. For this reason, even when the sheet S continuously generates (emits) the water vapor in the feeding passage 187, the air is discharged from the feeding passages 187, 183 and 184, so that a degree of the occurrence of the dew condensation particularly at the guiding members 231, 232 and 233 is reduced.

Incidentally, although the feeding passage 186 is in the blocked state, as described above, there are slight gaps between the guiding members 221 and 222 and the associated roller pair consisting of the fixing discharging roller pair 122 and the pre-discharging roller pair 123. For that reason, the water vapor emitted to the feeding passage 186 does not cause dew condensation but is gradually discharged to the outside of the feeding passage 186.

As described above, also according to the image forming apparatus 100 of the second embodiment, the lowering in temperature of the feeding passage 186 is suppressed, and in combination with the discharge of the water vapor in the feeding passage 181 by the air discharging device 300, it is possible to reduce the degree of the occurrence of the dew condensation particularly in the feeding passage 186. Further, the air in the feeding passage 187 is discharged to the outside of the apparatus main assembly 101 by the air blowing device 400, so that it is also possible to reduce the degree of the occurrence of the dew condensation in the feeding passage 187.

Incidentally, in the above-described first and second embodiments, the constitution in which the air discharging device 300 was disposed only on the pressing roller 152 side relative to the feeding passage 181 was described. However, the present invention is not limited thereto, but a constitution in which the air discharging device is disposed only on the heating belt 151 side relative to the feeding passage 181 or a constitution in which two air discharging devices are disposed on both sides relative to the feeding passage 181. That is, the air discharging device may only be required that at least one of the guiding members 201 and 202 which form the feeding passage 181 is provided with a through hole and the air discharging device is connected to the guiding member provided with the through hole.

Further, in the second embodiment, the constitution in which the air blowing device 400 was disposed only on one side (the pressing roller 152 side) relative to the feeding passage 187 was described. However, the present invention is not limited thereto, but a constitution in which the air blowing device is disposed only on the other side (the heating belt 151 side) relative to the feeding passage 187 or a constitution in which two air blowing devices are disposed on both sides relative to the feeding passage 187. That is, the air blowing device may only be required that at least one of the guiding members 231 and 233 which form the feeding passage 187 is provided with a through hole and the air discharging device is connected to the guiding member provided with the through hole.

Further, in the first and second embodiments, the constitution in which the sheet S can be discharged selectively from the two portions consisting of the first discharging roller pair 160 and the second discharging roller pair 161 was described. However, the present invention is not limited thereto, but for example as in the case of a desk(-top) printer, when the image forming apparatus discharges the sheet from one portion, a constitution in which the feeding passages 183 and 184 and the first switching flap F1 are not provided may also be employed. In this case, in the first embodiment, the feeding passage 182 is put in the blocked state only by the first discharging roller pair 122 and the first discharging roller pair 160. Further, in the second embodiment, the air in the feeding passage 187 is discharged only from the first discharging roller pair 160.

Further, in the first and second embodiments, the constitution in which the first switching flap F1 switches the feeding passage of the sheet was described. However, the present invention is not limited thereto, but a constitution in which an elastic member such as a rubber is provided at a free end portion or a base portion of the first switching flap F1 and blocks the flow of the air may also be employed. Further, in the second embodiment, a constitution in which the first switching flap F1 may also be formed in a comb-shape and the air can pass through the comb-shaped portion may also be employed.

Further, in the second embodiment, the constitution in which the blocking portion 500 included the lower wall 501*a* and the side wall 501*b* and formed the double structure with the air discharging duct 301 and the air blowing duct 401 was described. However, the present invention is not limited thereto, but a constitution in which the blocking portion 500 is formed by the upper wall 301*g* and the side wall 301*f* of the air discharging duct 301 and the lower wall 401*a* of the air blowing duct 401, i.e., a constitution of a single structure may also be employed.

According to the above-described embodiments, the temperature lowering of the second feeding passage is suppressed and in combination with the discharge of the water vapor in the first feeding passage by the discharging means, the degree of the occurrence of the dew condensation can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-123256 filed on Jul. 1, 2019, which is hereby incorporated by reference herein in its entirety.

What is claimed is:

1. An image forming apparatus comprising:

a fixing portion configured to fix an image on a sheet by heating the sheet;

a first guiding portion provided downstream of said fixing portion with respect to a sheet feeding direction and configured to form a first feeding passage along which the sheet is fed;

a second guiding portion provided downstream of said first feeding passage with respect to the sheet feeding direction and configured to form a second feeding passage along which the sheet is fed;

a first rotatable member pair provided between said first guiding portion and said second guiding portion with respect to the sheet feeding direction and configured to feed the sheet, wherein said first rotatable member pair includes one rotatable member and the other rotatable member which are in contact with each other over a full width of said first feeding passage with respect to a widthwise direction perpendicular to the sheet feeding direction in a state in which said first rotatable member pair does not feed the sheet;

an air discharger configured to discharge air from said first feeding passage to an outside of a main assembly of said image forming apparatus;

a second rotatable member pair provided downstream of said second guiding portion with respect to the sheet feeding direction and configured to feed the sheet, wherein said second rotatable member pair includes one rotatable member and the other rotatable member which are in contact with each other over a full width of said second feeding passage with respect to the widthwise direction in a state in which said second rotatable member pair does not feed the sheet;

a rotatable discharging member pair configured to discharge the sheet to the outside of said apparatus main assembly; and a third guiding portion forming a third feeding passage along which the sheet fed to said second feeding passage is fed toward said rotatable discharging member pair, wherein said second rotatable member is disposed between said second guiding portion and said third guiding portion with respect to the sheet feeding direction.

2. An image forming apparatus according to claim 1, wherein said fixing portion includes a rotatable heating member to be heated and a rotatable pressing member pressed against said rotatable heating member, and wherein said air discharger is provided on a side where said rotatable pressing member is provided.

3. An image forming apparatus according to claim 1, wherein said first guiding portion includes a pair of guiding members opposing each other, at least one of said guiding members being provided with a through hole communicating with said first feeding passage, and wherein said air discharger includes an air discharging duct connected to said guiding member provided with the through hole and communicating with the outside of said apparatus main assembly and includes an air discharging fan connected to said air discharging duct and configured to discharge air from an inside of said air discharging duct to the outside of said apparatus main assembly.

4. An image forming apparatus according to claim 1, further comprising, a branch passage guiding portion which forms a branch feeding passage branching from said third feeding passage and along which the sheet is fed toward said rotatable discharging member pair.

5. An image forming apparatus according to claim 4, further comprising, a transfer portion configured to transfer the image onto the sheet, and a re-feeding guiding portion forming a re-feeding passage which branches from said branch feeding passage and along which the sheet fed from said fixing portion is turned upside down and fed again toward said transfer portion.

6. An image forming apparatus according to claim 1, further comprising an air blower configured to blow the air to said third feeding passage.

7. An image forming apparatus according to claim 6, wherein said third guiding portion includes a pair of guiding members opposing each other, at least one of said guiding members being provided with a through hole communicating with said third feeding passage, and wherein said air blower includes an air blowing duct connected to said guiding member provided with the through hole and communicating with the outside of said apparatus main assembly and includes an air blowing fan connected to said air blowing duct and configured to such the air from the outside of said apparatus main assembly to an inside of said air blowing duct.

8. An image forming apparatus according to claim 6, further comprising a blocking portion provided between said first rotatable member pair and said second rotatable member pair on a side opposite from said second feeding passage with respect to said second guiding portion and configured to block a flow of the air from said air blower toward said air discharger.

9. An image forming apparatus according to claim 6, wherein said rotatable discharging member pair includes a plurality of rollers juxtaposed in an axial direction, and wherein the air blown from said air blower to said third feeding passage passes through said rotatable discharging member pair and is discharged from said third feeding passage to the outside of said apparatus main assembly.

10. An image forming apparatus according to claim 6, further comprising, another rotatable discharging member pair provided at a position different from a position of said rotatable discharging member pair and configured to discharge the sheet to the outside of said apparatus main assembly, and a branch passage guiding portion which forms a branch feeding passage branching from said third feeding passage and along which the sheet is fed toward said another rotatable discharging member pair, wherein said another rotatable discharging member pair includes a plurality of rollers juxtaposed in an axial direction, and wherein the air blown from said air blower passes through said another rotatable discharging member pair and is discharged to the outside of said apparatus main assembly.

11. An image forming apparatus according to claim 10, further comprising a rotatable branch passage member pair provided in said branch feeding passage and configured to feed the sheet, wherein said rotatable branch passage member pair include a plurality of rollers juxtaposed in an axial direction, and wherein the air blown from said air blower passes through said rotatable branch passage member pair and communicates with said another rotatable pressing member pair.

12. An image forming apparatus according to claim 10, further comprising, a transfer portion configured to transfer the image onto the sheet, and a re-feeding guiding portion forming a re-feeding passage which branches from said branch feeding passage and along which the sheet fed from said fixing portion is turned upside down and fed again toward said transfer portion.

13. An image forming apparatus comprising:

a fixing portion configured to fix an image on a sheet by heating the sheet;

a first guiding portion provided downstream of said fixing portion with respect to a sheet feeding direction and configured to form a first feeding passage along which the sheet is fed;

a second guiding portion provided downstream of said first feeding passage with respect to the sheet feeding direction and configured to form a second feeding passage along which the sheet is fed;

a first rotatable member pair provided between said first guiding portion and said second guiding portion with respect to the sheet feeding direction and configured to feed the sheet, wherein said first rotatable member pair includes one rotatable member and the other rotatable member which are in contact with each other over a full width of the sheet with respect to a widthwise direction perpendicular to the sheet feeding direction;

an air discharger configured to discharge air from said first feeding passage to an outside of a main assembly of said image forming apparatus;

a second rotatable member pair provided downstream of said second guiding portion with respect to the sheet feeding direction and configured to feed the sheet, wherein said second rotatable member pair includes one rotatable member and the other rotatable member which are in contact with each other over a full width of the sheet with respect to the widthwise direction;

a third guiding portion provided downstream of said second rotatable member pair with respect to the sheet feeding direction and configured to form a third feeding passage along which the sheet is fed;

a discharger provided downstream of said third feeding passage with respect to the sheet feeding direction and configured to discharge the sheet to the outside of said apparatus main assembly; and an air blower configured to blow the air, wherein said third guiding portion includes a pair of guiding members opposing each other, at least one of said guiding members being provided with a through hole, and said air blower blows the air to said third feeding passage through said through hole.

14. An image forming apparatus according to claim 13, wherein said first guiding portion includes a pair of first guiding members opposing each other, at least one of said first guiding members being provided with a first through hole communicating with said first feeding passage, and wherein said air discharger includes an air discharging duct connected to said first guiding member provided with the first through hole and communicating with the outside of said apparatus main assembly and includes an air discharging fan connected to said air discharging duct and configured to discharge air from an inside of said air discharging duct to the outside of said apparatus main assembly.

15. An image forming apparatus according to claim 14, wherein said discharger includes a plurality of rollers juxtaposed in an axial direction, and wherein the air blown from said air blower to said third feeding passage passes through a space between said plurality of rollers and is discharged from said third feeding passage to the outside of said apparatus main assembly.

16. An image forming apparatus according to claim 13, wherein said air blower includes an air blowing duct connected to said third guiding member provided with the through hole and communicating with the outside of said apparatus main assembly and includes an air blowing device connected to said air blowing duct and configured to such the air from the outside of said apparatus main assembly to an inside of said air blowing duct.

17. An image forming apparatus according to claim 13, wherein said fixing portion includes a rotatable heating member to be heated and a rotatable pressing member pressed against said rotatable heating member, and wherein said air discharger is provided on a side where said rotatable pressing member is provided.

18. An image forming apparatus comprising:

a fixing portion configured to fix an image on a sheet by heating the sheet;

a first guiding portion provided downstream of said fixing portion with respect to a sheet feeding direction and configured to form a first feeding passage along which the sheet is fed;

a second guiding portion provided downstream of said first feeding passage with respect to the sheet feeding direction and configured to form a second feeding passage along which the sheet is fed;

a first roller pair provided between said first guiding portion and said second guiding portion with respect to the sheet feeding direction and configured to nip and feed the sheet, wherein said first roller pair includes one roller and another roller which are in contact with each other over a full width of said first feeding passage with respect to a widthwise direction perpendicular to the sheet feeding direction in a state in which said first roller pair does not feed the sheet;

an air discharger configured to discharge air from said first feeding passage to an outside of a main assembly of said image forming apparatus; and a second roller pair provided downstream of said second guiding portion with respect to the sheet feeding direction and configured to nip and feed the sheet, wherein said second roller pair includes one roller and another roller which are in contact with each other over a full width of said second feeding passage with respect to the widthwise direction in a state in which said second roller pair does not feed the sheet.

19. An image forming apparatus according to claim 18, further comprising a third guiding portion provided downstream of said guiding portion with respect to the sheet feeding direction and configured to form a third feeding passage along which the sheet is fed;

a discharger provided downstream of said third feeding passage with respect to the sheet feeding direction and configured to discharge the sheet to the outside of said apparatus main assembly;

an air blower configured to blow the air, and wherein said second rotatable member is disposed between said second guiding portion and said third guiding portion with respect to the sheet feeding direction, wherein said third guiding portion includes a pair of guiding members opposing each other, at least one of said guiding members being provided with a through hole, and said air blower blows the air to said third feeding passage through said through hole.

* * * * *